US011566547B2

(12) United States Patent
Sato et al.

(10) Patent No.: US 11,566,547 B2
(45) Date of Patent: Jan. 31, 2023

(54) EXHAUST MUFFLER

(71) Applicant: HONDA MOTOR CO., LTD., Tokyo (JP)

(72) Inventors: Junya Sato, Tokyo (JP); Ryuta Niimura, Tokyo (JP); Junichiro Suzuki, Tokyo (JP)

(73) Assignee: Honda Motor Co., Ltd., Tokyo (JP)

( * ) Notice: Subject to any disclaimer, the term of this patent is extended or adjusted under 35 U.S.C. 154(b) by 68 days.

(21) Appl. No.: 17/200,152

(22) Filed: Mar. 12, 2021

(65) Prior Publication Data

US 2021/0301693 A1 Sep. 30, 2021

(30) Foreign Application Priority Data

Mar. 31, 2020 (JP) ..... JP2020-063575

(51) Int. Cl.
*F01N 1/18* (2006.01)
*F01N 1/02* (2006.01)
*F01N 1/08* (2006.01)

(52) U.S. Cl.
CPC ..... *F01N 1/026* (2013.01); *F01N 1/082* (2013.01); *F01N 2310/06* (2013.01); *F01N 2470/02* (2013.01); *F01N 2470/08* (2013.01); *F01N 2470/24* (2013.01)

(58) Field of Classification Search
CPC ... F01N 1/026; F01N 2470/08; F01N 2490/06
See application file for complete search history.

(56) References Cited

U.S. PATENT DOCUMENTS 4,829,766 A * 5/1989 Henkel ..... F01N 3/022 60/303
5,224,973 A * 7/1993 Hoppenstedt ..... F01N 3/032 219/535
5,293,742 A * 3/1994 Gillingham ..... F01N 3/0226 60/303
2021/0246818 A1* 8/2021 Kondo ..... F01N 1/084

FOREIGN PATENT DOCUMENTS

JP S63-132816 U 8/1988

* cited by examiner

*Primary Examiner* — Jonathan R Matthias
(74) *Attorney, Agent, or Firm* — Carrier Shende & Associates, P.C.; Joseph P. Carrier; Fulchand P. Shende

(57) ABSTRACT

An exhaust muffler has an outer cylinder into which an exhaust gas from an engine is introduced and a muffling member made of a foamed ceramic material. The outer cylinder has an inner cylinder through which the exhaust gas passes, a part of the muffling member is supported by an outer wall of the inner cylinder via a holding member. The inner cylinder includes, in an area where the inner cylinder overlaps with the muffling member with respect to axial direction of the inner cylinder, a porous wall portion formed with communication holes communicating an inside and an outside of the inner cylinder. The holding member is arranged at a position where it does not overlap with a part of the porous wall portion, so that muffling effect is enhanced, and the muffling member having a low resistance to impact forces can be supported stably by the inner cylinder.

10 Claims, 7 Drawing Sheets

EXHAUST MUFFLER

TECHNICAL FIELD

The present invention relates to an exhaust muffler that muffles exhaust noise of an internal combustion engine.

BACKGROUND ART

A foamed ceramic material is known for use as a muffling member arranged in an introduction chamber of an exhaust muffler. Patent Document 1 discloses a muffler structure using a foamed ceramic material for a muffling member, in which a mat member is wound on the outside of an inner cylinder to set the position of the foamed ceramic material. The foamed ceramic material has an advantage of a high muffling effect and light weight.

In the exhaust muffler having the above-described conventional structure, an exhaust passage, through which an exhaust gas from an engine flows, is constituted by a cylindrical member, a porous wall portion formed with a large number of small holes is provided in the cylindrical member, and the peripheral surface of the porous wall portion is covered with the muffling member of a foamed ceramic material, to provide a sound absorbing effect. The muffling member of the foamed ceramic material is supported by the porous wall portion of the cylindrical member via a cylindrical holding member formed of steel wool or the like.

PRIOR ART DOCUMENT

[Patent Document]
Patent Document 1: JP S63-132816 U

SUMMARY OF THE INVENTION

Underlying Problems to be Solved by the Invention

In the muffler of the above-described conventional exhaust muffler, although the muffling member of the foamed ceramic material is arranged around the cylindrical member of the exhaust passage, the exhaust gas is not positively caused to flow from within the cylindrical member of the exhaust passage into the muffling member of the foamed ceramic material, and it is intended to absorb high frequency sound components of pressure waves in the exhaust gas particularly to reduce sound pressure level.

When the above arrangement of the exhaust muffler is applied, in order to further enhance a muffling effect, to a structure wherein an inner cylinder through which exhaust gas from the engine flows is provided in an outer case cylinder defining therein an introduction chamber into which exhaust gas is introduced, and wherein a muffling member made of a foamed ceramic material is arranged around the inner cylinder and exhaust gas is positively caused to flow from within the inner cylinder into and through the muffling member of the foamed ceramic material, the flow of the exhaust gas from within the inner cylinder to the muffling member is resisted by a holding member provided between the muffling member and the porous wall portion of the cylindrical member, and this makes it difficult to enhance the muffling effect.

An object of the present invention is to provide an exhaust muffler of the above-stated structure in which muffling effect is enhanced and in which muffling member made of foamed ceramic material with a low resistance to impact forces can be stably supported by an inner cylinder.

Means to Solve the Problems

In order to achieve the object above, according to the present invention, there is provided an exhaust muffler for an engine, comprising an outer cylinder that forms an introduction chamber into which an exhaust gas from the engine is introduced, and a muffling member through which the exhaust gas flows, the muffling member being arranged in the introduction chamber and made of a foamed ceramic material, wherein an inner cylinder through which the exhaust gas passes is provided in the outer cylinder, at least a part of the muffling member is supported by an outer wall of the inner cylinder via a holding member, the inner cylinder includes, in an area where the inner cylinder overlaps with the muffling member with respect to an axial direction of the inner cylinder, a porous wall portion provided with communication holes communicating an inside and an outside of the inner cylinder, the holding member is arranged at a position where the holding member does not overlap with at least a part of the porous wall portion with respect to the axial direction of the inner cylinder, and arrangement is such that the exhaust gas having passed through the muffling member flows into the inner cylinder through the communication holes.

Since the present invention is configured as above, while the foamed ceramic material is used as the muffling member, flow of the exhaust gas through the foamed ceramic material as the muffling member into the inner cylinder is improved with a muffling effect enhanced, and the muffling member of the foamed ceramic material having a low resistance to impact forces can be stably supported or held by the inner cylinder.

In a preferred form of the invention, the muffling member has an exhaust gas inflow surface through which the exhaust gas in the introduction chamber is introduced into the muffling member, and with respect to the axial direction of the inner cylinder, the exhaust gas inflow surface is provided on a side opposite to the communication holes across the holding member.

According to the above configuration, while the exhaust gas is positively passed through the muffling member of the foamed ceramic material, the holding member is provided at the position where the holding member does not overlap with the porous wall portion provided with the communication holes, so that the exhaust flow is hardly obstructed and a pressure loss can be reduced. According to the above configuration, an exhaust flow path of the muffling member can be lengthened, and the muffling effect can be enhanced.

In a preferred form of the invention, the muffling member has an outer peripheral surface provided with an outer wall that suppresses passing of the exhaust gas.

According to the above configuration, since the muffling member is supported by the inner cylinder via the holding member, even if the muffling member is provided with the outer wall that suppresses passing of the exhaust gas, the outer wall does not require a rigidity sufficient to support the muffling member, a lightweight outer wall can be used, and the weight of the exhaust muffler can be reduced.

In a further preferred form of the invention, the muffling member is provided with a bottom wall in contact with the inner cylinder on a side opposite to the holding member across the communication holes of the inner cylinder with respect to the axial direction of the inner cylinder.

According to the above configuration, since the bottom wall is in contact with the inner cylinder, the bottom wall can also support a part of the muffling member, and the bottom wall and the holding member can support both ends of the muffling member across the porous wall portion of the inner cylinder, so that the supporting rigidity of the muffling member is improved.

In a still further preferred form of the invention, the outer wall of the inner cylinder is provided with a positioning projection on a rear side adjacent to the holding member with respect to the axial direction of the inner cylinder.

According to the above configuration, since the outer wall of the inner cylinder is provided with the positioning projection, the muffling member to which the holding member is attached can be easily assembled to the inner cylinder.

In another preferred form of the invention, a cushioning material is interposed between the outer wall and the outer peripheral surface of the muffling member.

According to the above configuration, the cover member and the cushioning material further improve the protection performance of the muffling member.

Advantageous Effects of the Invention

According to the present invention, a muffling effect can be enhanced by the use of a foamed ceramic material as a muffling member, and the muffling member of the foamed ceramic material having a low resistance to impact forces can be stably supported by an inner cylinder.

MODES FOR CARRYING OUT THE INVENTION

Figure 1:
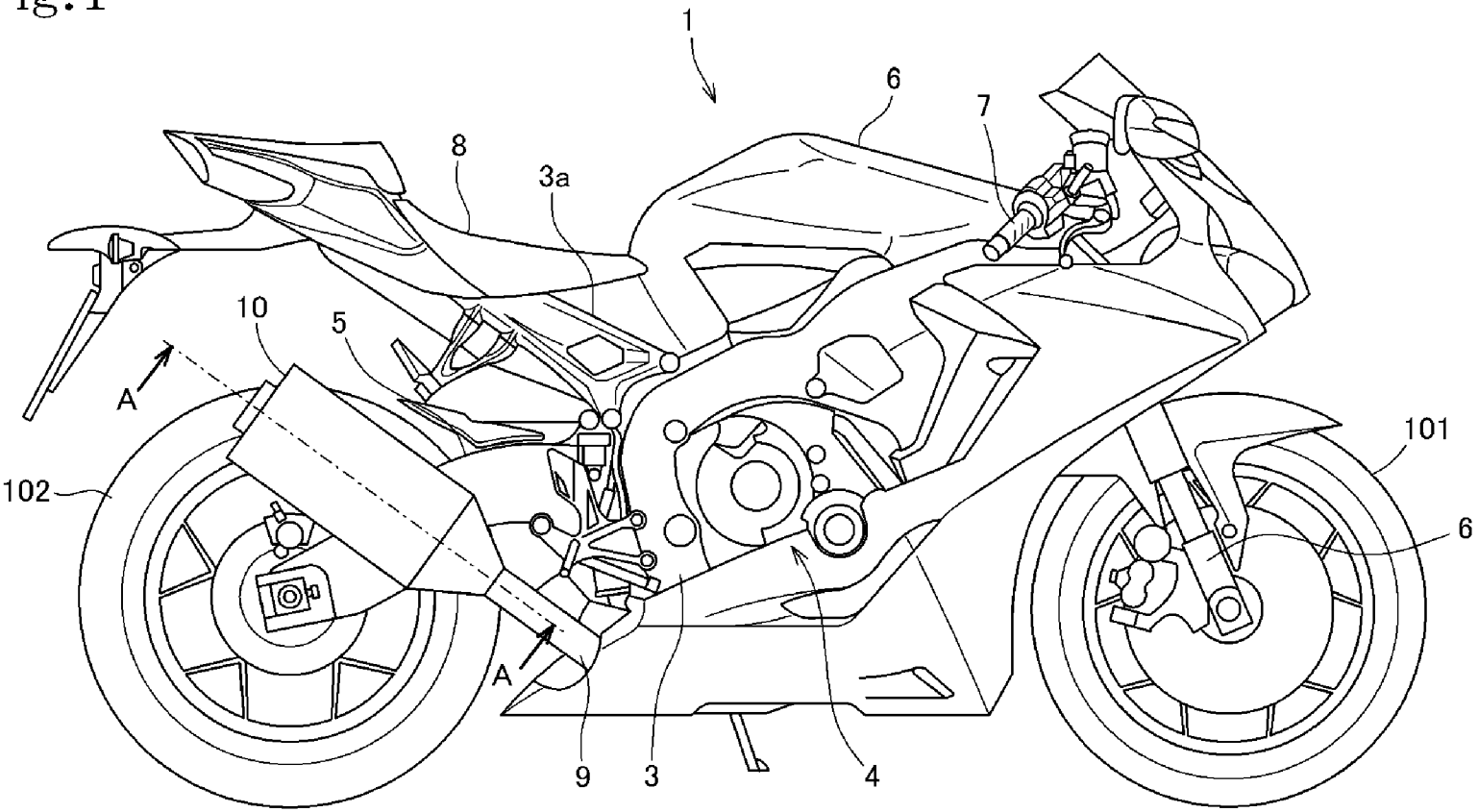
FIG. 1 is a right-side view of a motorcycle to which an embodiment of the present invention is applied.

An exhaust muffler according to a first embodiment of the present invention will be described with reference to FIGS. 1 to 5. FIG. 1 is a right-side view of a motorcycle 1 as an example of a saddle-riding type vehicle to which the exhaust muffler of the present invention is applied. Note that the exhaust muffler of the present invention can also be applied to another saddle-riding type vehicle. In the description of the exhaust muffler of the present invention, "front" and "rear" are in accordance with the front-rear direction of the vehicle on which the exhaust muffler is mounted.

The motorcycle 1 includes a front wheel 101, a rear wheel 102, and a vehicle body frame 3 forming a skeleton of the motorcycle 1. The vehicle body frame 3 supports an internal combustion engine 4 that drives the rear wheel 102. The engine 4 is, for example, a multi-cylinder four-cycle engine and is driven by fuel stored in and supplied from a fuel tank 6. A driving force of the engine 4 is transmitted to the rear wheel 102 via a transmission mechanism not illustrated. A combustion gas (exhaust gas) exhausted from an exhaust port of the engine 4 is exhausted through an exhaust pipe 9, and an exhaust noise is muffled by an exhaust muffler 10 according to the embodiment of the present invention. The exhaust muffler 10 is arranged on a lateral side portion of the vehicle body.

A seat frame 3*a* for supporting a seat 8 for a rider is connected to a rear portion of the vehicle body frame 3. A swing arm 5 is swingably supported by the rear portion of the vehicle body frame 3, and the rear wheel 102 is rotatably supported by the swing arm 5.

Figure 2:
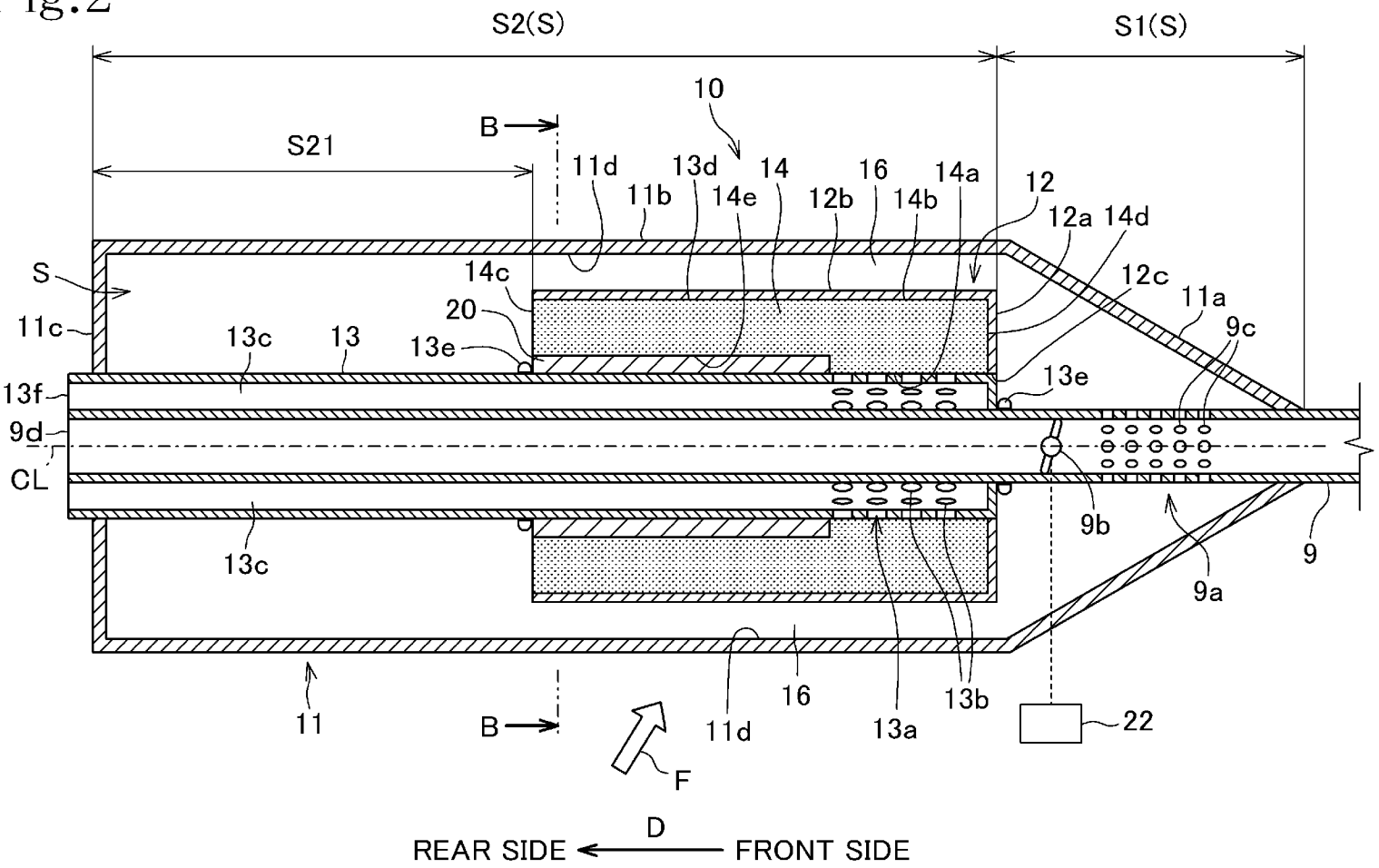
FIG. 2 is a cross-sectional view taken along a line A-A of FIG. 1, and is a cross-sectional view through a center axis of an exhaust muffler according to the embodiment of the present invention.
Figure 3:
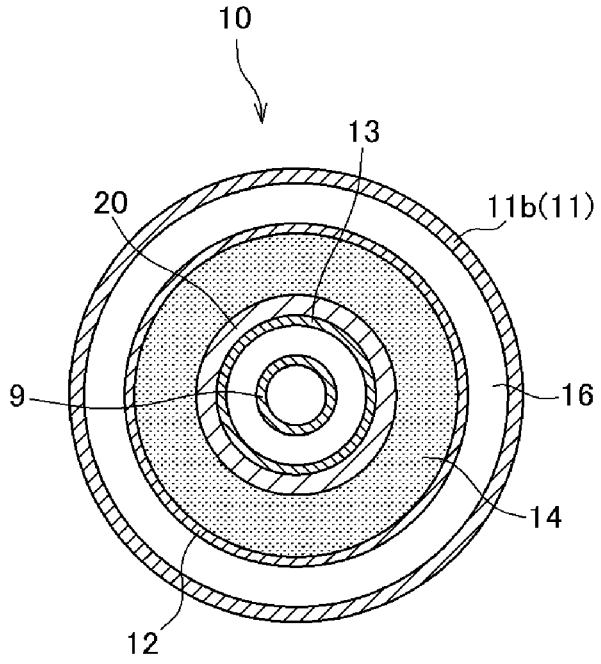
FIG. 3 is a cross-sectional view taken along a line B-B of FIG. 2.

As illustrated in FIGS. 2 and 3, the exhaust muffler 10 includes an outer cylinder 11 constituting an outer shell or wall of the exhaust muffler 10. The outer cylinder 11 is a hollow body, and an inner space of the outer cylinder 11 forms an introduction chamber S into which the exhaust gas from the engine 4 is introduced from the exhaust pipe 9. The outer cylinder 11 includes a front portion 11*a* on a front side, a main body portion 11*b*, and a rear wall portion 11*c* in the front-to-rear direction of the motorcycle 1. In the present embodiment, the main body portion 11*b* is a cylindrical body, and the front portion 11*a* has a tapered shape whose diameter is increasingly changed from the outer diameter of the exhaust pipe 9 to the outer diameter of the main body portion 11*b*. The rear wall portion 11*c* is a disk-shaped wall body that closes a rear end opening of the main body portion lib.

In the present embodiment, the exhaust pipe 9 is a cylindrical pipe coaxial with the main body portion lib with respect to a center axis CL, and is a metal pipe. A plurality of communication holes 9*c* is formed in a peripheral wall of a hole section 9*a* that is a partial section of the exhaust pipe 9. The hole section 9*a* is positioned in the front portion 11*a*, and the exhaust gas in the exhaust pipe 9 is introduced into the front portion 11*a* through the communication holes 9*c* of the hole section 9*a*. A control valve 9*b* that controls the amount of exhaust gas passing in the exhaust pipe 9 is arranged in a middle portion of the exhaust pipe 9, which is a rear side of the hole section 9*a* in the front-to-rear direction. Controlling the opening of the control valve 9*b* by a controller 22 makes it possible to control the ratio of the amount of exhaust gas that passes directly through the exhaust pipe 9 and is then exhausted from a rear end of the exhaust pipe 9 to the outside air.

An inner cylinder 13 is arranged in the introduction chamber S. In the present embodiment, the inner cylinder 13 is a cylindrical pipe that is coaxial with the exhaust pipe 9 and has a larger diameter than the exhaust pipe 9. The inner cylinder 13 is a metal pipe. The main body portion 11*b* of the outer cylinder 11, the inner cylinder 13, and the exhaust pipe 9 constitute a triple pipe structure having the center axis CL in common. The inner cylinder 13 is closed at its front end and opened at its rear end. The inner cylinder 13 is supported on a rear end side by the rear wall portion 11*c* of the outer cylinder 11, and is supported on a front-end side by the front portion 11*a* of the outer cylinder 11 via the exhaust pipe 9.

The inner cylinder 13 includes, in a wall portion constituting a partial section on its front-end side, a porous wall portion 13*a* in which a plurality of communication holes 13*b* is formed. Furthermore, an exhaust passage 13*c* is formed between an inner peripheral surface of the inner cylinder 13 and an outer wall surface of the exhaust pipe 9. The exhaust gas introduced into the introduction chamber S flows to be introduced into the exhaust passage 13*c* via the communication holes 13*b* of the porous wall portion 13*a*, and is exhausted to the outside air from the rear end of the inner cylinder 13. Thus, the inner cylinder 13 can be used as an exhaust passage. The radial distance between the inner wall surface of the inner cylinder 13 and the outer wall surface of the exhaust pipe 9, which is the transverse width of the exhaust passage 13*c*, is within a range of, for example, 2 to 4 mm, and is, for example, 3 mm.

The inner cylinder 13 supports a muffling member 14 via a holding member 20.

The muffling member 14 is a block of a foamed ceramic material. As the foamed ceramic material, a known foamed ceramic can be used in which innumerable pores communicating with each other are formed so that the exhaust gas can pass therethrough.

The muffling member 14 is formed in a substantially cylindrical shape. An inner peripheral surface 14*a* of the muffling member 14 is formed with a cylindrical recess of a predetermined length from an exhaust gas inflow surface 14*c*, which is a rear end surface of the muffling member 14 and through which the exhaust gas flows into the muffling member 14. The recess serves as a holding member fitting recess 14*e*. The holding member fitting recess 14*e* is provided so as to avoid at least a part of the porous wall portion 13*a* of the inner cylinder 13.

The holding member 20 is made of a cushioning material. More specifically, the holding member 20 is a mat member such as steel wool or glass fiber and is formed in a substantially cylindrical shape corresponding to the holding member fitting recess 14*e*. The holding member 20 is fitted in the holding member fitting recess 14*e* of the muffling member 14. The muffling member 14 and the holding member 20 constitute a substantially cylindrical structure. The inner cylinder 13 is press-fitted into the cylindrical structurer constituted by the muffling member 14 and the holding member 20, to support the muffling member 14 via the holding member 20.

The muffling member 14 is supported via the holding member 20 positioned between the muffling member 14 and the inner cylinder 13. The inner cylinder 13 is a metal pipe and has a higher rigidity than the muffling member 14, which is the foamed ceramic material. Thus, the inner cylinder 13 can hold, together with the holding member 20, the muffling member using the foamed ceramic material by supporting the muffling member 14 from the inside while vibration and impact from the outside are suppressed.

Furthermore, the muffling member 14 is arranged separately from an inner wall surface 11*d* of the outer cylinder 11. Such an arrangement can improve the protection performance of the muffling member 14 made of the foamed ceramic material which is not high in strength against impact. For example, when an obstacle such as a curb on a road collides with the outer cylinder 11, or when the motorcycle 1 falls and the outer cylinder 11 collides against the ground, an impact may act on the main body portion lib as indicated by an arrow F in FIG. 2. However, the impact is not influential since the muffling member 14 is separated from the inner wall surface 11*d* of the outer cylinder 11, and a gap 16 is formed between the inner wall surface 11*d* and an outer peripheral surface 14*b* of the muffling member 14. As indicated by the arrow F, even if the impact acts on the main body portion 11*b*, the impact does not act directly on the muffling member 14, and the gap 16 serves as a crash zone of the outer cylinder 11 to mitigate the impact acting on the muffling member 14. As a result, it is possible to reduce the occurrence of cracks in the muffling member 14.

Around the muffling member 14, a cover member 12 is provided. The cover member 12 is a cylindrical member, and, in the case of the present embodiment, is a cylindrical pipe that is coaxial with the exhaust pipe 9 and has a diameter larger than the exhaust pipe 9 and smaller than the main body portion 11*b* of the outer cylinder 11. The cover member 12 includes a bottom wall portion 12*a* at a front end and a cylindrical outer wall portion 12*b*, and is open on a rear end side. The cover member 12 is made of metal, for example, and the disk-shaped bottom wall portion 12*a* is fixed to the inner cylinder 13 at a portion of a center hole 12*c* of the bottom wall portion 12*a* by welding or the like. The outer wall portion 12*b* surrounds the outer peripheral surface 14*b* of the muffling member 14. An end surface 14*d* of the muffling member abuts on the bottom wall portion 12*a*, and the muffling member 14 is held by the cover member 12 in the front-rear direction. The cover member 12 further improves the protection performance of the muffling member 14.

The bottom wall portion 12*a* also functions as a partition wall portion that partitions the introduction chamber S into a first air chamber S1 on the front side and a second air chamber S2 on the rear side. The gap 16 in the second air chamber S2 has a radial distance between the cylindrical outer wall portion 12*b* and the main body portion 11*b* of the outer cylinder 11, which distance is within a range of, for example, 4 to 6 mm, and is, for example, 5 mm.

The muffling member 14 is positioned on the front side of the second air chamber S2, and the second air chamber S2 includes a return chamber S21 on the rear side. Arranging the muffling member 14 not in the first air chamber S1 on the front side but in the second air chamber S2 on the rear side makes it possible to reduce an influence of the muffling member 14 as exhaust resistance to the exhaust gas. The exhaust gas flows in from the return chamber S21 through the exhaust gas inflow surface 14*c*, which is an end surface of the muffling member 14. Since the exhaust gas whose flow velocity has been reduced flows into the muffling member 14, the exhaust resistance is suppressed to exhibit the muffling effect. In the present embodiment, a part of the inner peripheral surface 14*a* of the muffling member 14 overlaps with the porous wall portion 13*a* of the inner cylinder 13, and the exhaust gas flowing from the exhaust gas inflow surface 14*c* into the muffling member 14 flows out, while being muffled, into the inner cylinder 13 through the communication holes 13*b* of the porous wall portion 13*a*. Since the muffling member 14 is arranged at a position close to the porous wall portion 13*a* as described above, the muffling member 14 can be arranged on a further downstream side of the exhaust gas flow, whereby the muffling effect can be improved while the influence of the muffling member 14 as the exhaust resistance is reduced.

Figure 4:
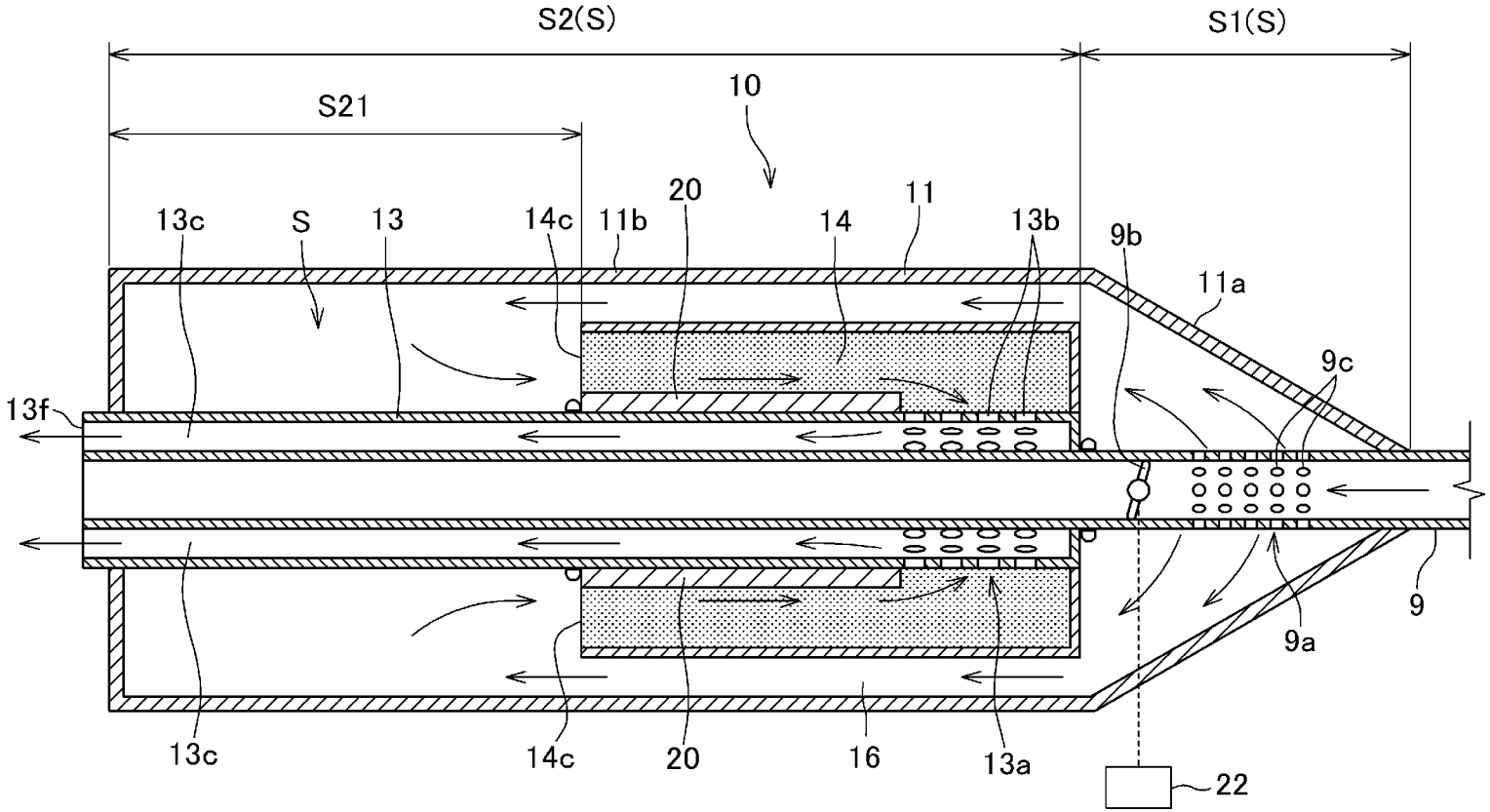
FIG. 4 is an explanatory view showing exhaust flow in the exhaust muffler.

How the exhaust gas flows will be described with reference to FIGS. 4 and 5. For example, the controller 22 reduces the opening of the control valve 9*b* when the engine 4 is in a low rotational range or middle rotational range, and the controller 2 increases the opening of the control valve 9*b* when the engine 4 is in a high rotational range. FIG. 4 illustrates a case where the control valve 9*b* is fully closed. In this case, the flow of exhaust gas is indicated by arrows. The exhaust gas in the exhaust pipe 9 is introduced into the first air chamber S1 through the communication holes 9*c* of the hole section 9*a*, then passes through the gap 16, and is introduced into the return chamber S21. Thereafter, the exhaust gas enters the muffling member 14 from the exhaust gas inflow surface 14*c* of the muffling member 14, passes through the communication holes 13*b* of the porous wall portion 13*a* of the inner cylinder 13, and enters the inner cylinder 13. When the exhaust gas passes through the muffling member 14, the exhaust noise is muffled. The exhaust gas then passes through the exhaust passage 13*c* of the inner cylinder 13 and is discharged into the atmosphere from a downstream end 13*f* of the inner cylinder 13.

Figure 5:
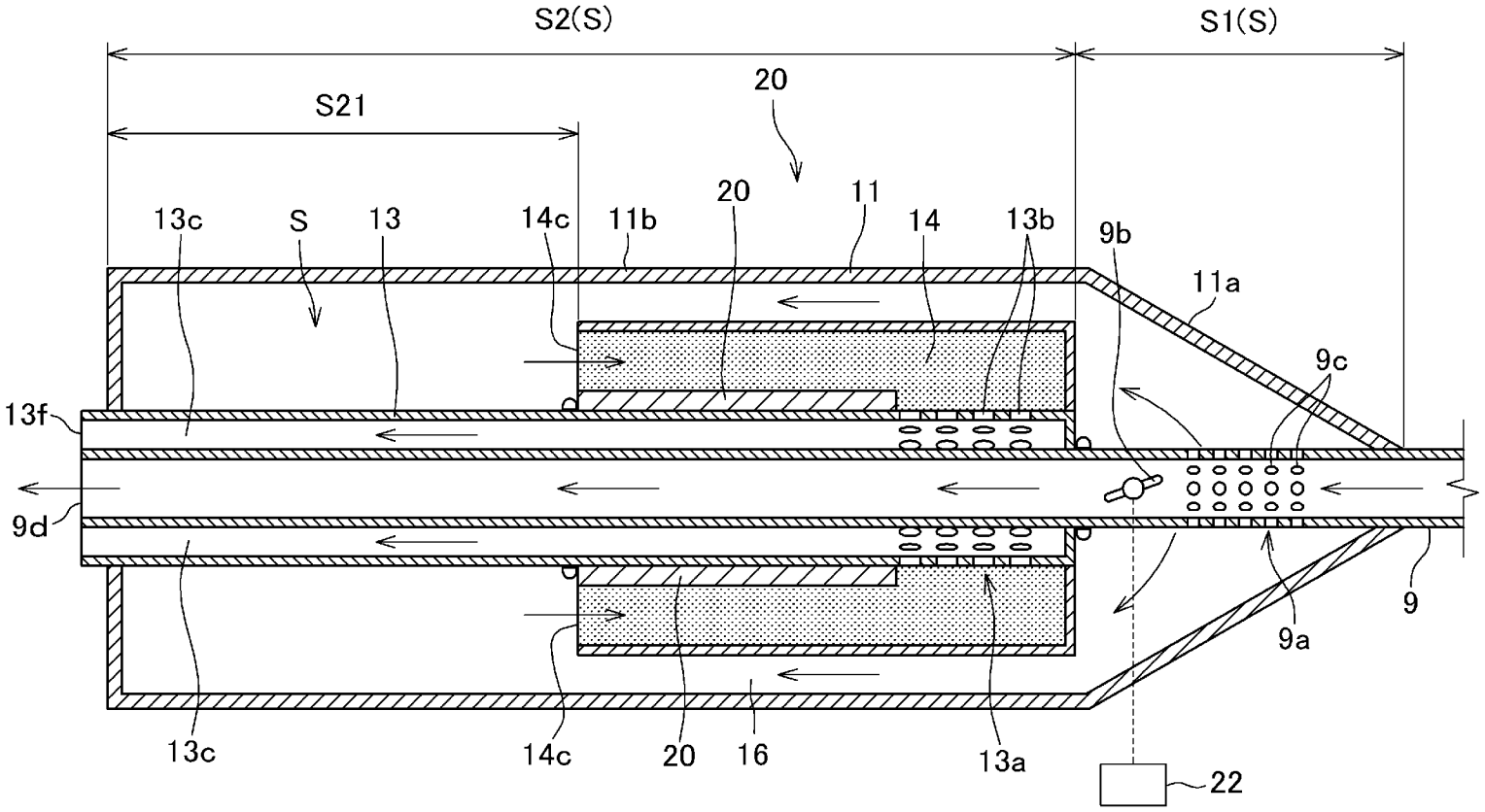
FIG. 5 is an explanatory view of the exhaust flow in the exhaust muffler in a different state.

FIG. 5 illustrates a case where the control valve 9*b* is opened. In this case, the flow of exhaust gas is indicated by arrows. The exhaust gas in the exhaust pipe 9 is divided into an exhaust gas directly passing through the exhaust pipe 9 and discharged from a downstream end 9*d* of the exhaust pipe 9 and into an exhaust gas introduced into the first air chamber S1 through the communication holes 9*c* of the hole section 9*a*. The larger the opening degree of the control valve 9*b* is, the higher the ratio of the exhaust gas directly passing through the exhaust pipe 9 and discharged from the downstream end 9*d* of the exhaust pipe 9 into the atmosphere, which enhances an exhaust efficiency. The flow of exhaust gas introduced into the first air chamber S1 is the same as that described with reference to FIG. 4.

Since the exhaust muffler 10 of the present embodiment is configured as described above, the following effects can be obtained.

The exhaust muffler 10 according to the present embodiment includes the outer cylinder 11 that forms the introduction chamber S into which the exhaust gas from the engine 4 is introduced, and the muffling member 14 arranged in the introduction chamber S and made of the foamed ceramic material, the inner cylinder 13 through which the exhaust gas passes is provided in the outer cylinder 11. Further, at least a part of the muffling member 14 is supported by the inner cylinder 13 via the holding member 20, the inner cylinder 13 includes the porous wall portion 13*a* provided with the communication holes 13*b* communicating the inside and the outside of the inner cylinder 13 in an area where the inner cylinder 13 overlaps with the muffling member 14 with respect to the front-rear direction, that is, in an axial direction of the inner cylinder 13, and the holding member 20 is arranged at a position where the holding member 20 does not overlap with at least a part of the porous wall portion 13*a* in the axial direction of the inner cylinder 13. For this reason, while the foamed ceramic material is used as the muffling member, the circulation of the exhaust gas through the foamed ceramic as the muffling member 14 into the inner cylinder 13 is improved, so that the muffling effect can be enhanced, and the muffling member 14 of the foamed ceramic material having a low resistance to impact forces can be stably supported in position by the inner cylinder 13.

Furthermore, the exhaust gas is introduced into the muffling member 14 from the exhaust gas inflow surface 14*c*, and the exhaust gas having passed through the inside of the muffling member 14 flows into the inner cylinder 13 through the communication holes 13*b*. Thus, while the exhaust gas is positively passed into the muffling member 14 of the foamed ceramic material, the holding member 20 is provided at the position where the holding member 20 does not overlap with the porous wall portion 13*a* provided with the communication holes 13*b*, so that the exhaust flow is hardly obstructed and a pressure loss can be reduced.

With respect to the axial direction of the inner cylinder 13, the exhaust gas inflow surface 14*c* of the muffling member 14 is provided on a side opposite to the communication holes 13*b* of the inner cylinder 13 across the holding member 20, so that flow path through which the exhaust gas passes in the muffling member 14 can be lengthened, and the muffling effect can be enhanced.

The outer peripheral surface 14*b* of the muffling member 14 is covered with the outer wall portion 12*b* of the cover member 12. The muffling member 14 is supported basically by the inner cylinder 13 via the holding member 20. Therefore, even if the muffling member 14 is provided with the outer wall portion 12*b*, the outer wall portion 12*b* does not require a rigidity sufficient to support the muffling member 14, so that the lightweight outer wall portion 12*b* can be used, and the weight of the whole exhaust muffler 10 can be reduced. Since the introduction of the exhaust gas from the outer peripheral surface 14*b* of the muffling member 14 is suppressed by the outer wall portion 12*b*, the flow path in the muffling member 14 can be lengthened.

The muffling member 14 is in contact with the bottom wall portion 12*a* supported by the inner cylinder 13 and in contact with the inner cylinder 13 on a side opposite to the holding member 20 across the porous wall portion 13*a* of the inner cylinder 13 provided with the communication holes 13*b* with respect to the axial direction of the inner cylinder 13, so that both the inner cylinder 13, and the bottom wall portion 12*a* of the cover member 12 can support the muffling member 14. Moreover, since the bottom wall portion 12*a* of the cover member 12 and the holding member 20 can support both ends of the muffling member 14 across the porous wall portion 13*a* of the inner cylinder 13, the supporting rigidity of the muffling member 14 is improved.

An outer wall of the inner cylinder 13 is provided with a positioning projection or projections 13*e* positioned adjacent to the holding member 20 on the rear side with respect the axial direction of the inner cylinder 13, and thus, the muffling member 14 to which the holding member 20 is attached can be easily assembled to the inner cylinder 13.

Figure 6:
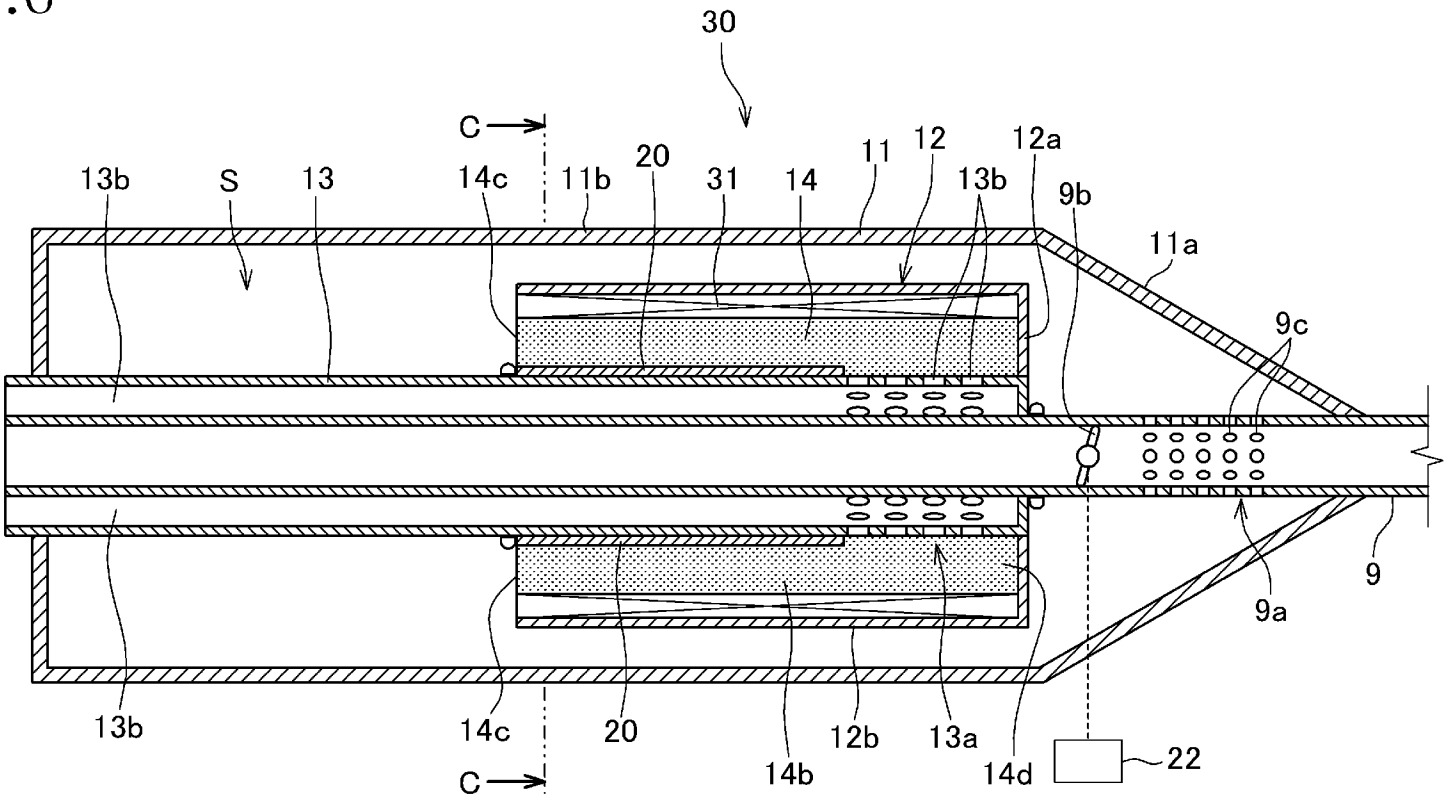
FIG. 6 is a cross-sectional view of an exhaust muffler according to another embodiment of the present invention.
Figure 7:
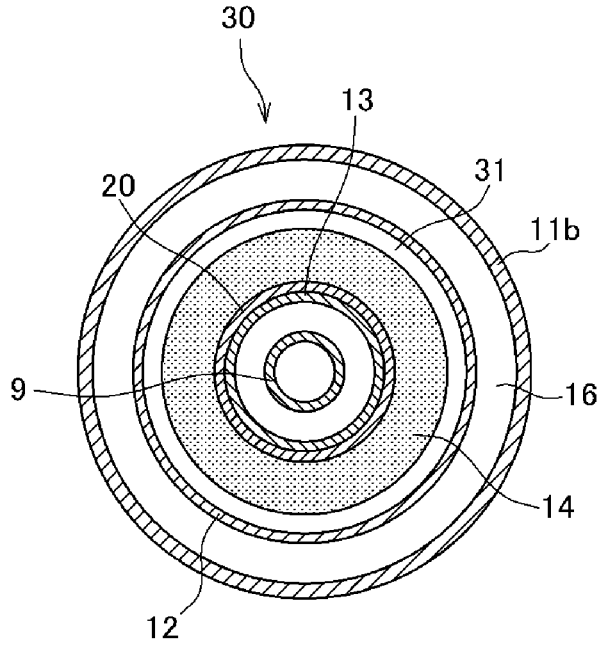
FIG. 7 is a cross-sectional view taken along a line C-C of FIG. 6.

An exhaust muffler 30 according to a second embodiment of the present invention will be described with reference to FIGS. 6 and 7. The same components as those in the exhaust muffler 10 of the first embodiment are applied with the same reference signs. In the exhaust muffler 10 of the first embodiment, the outer peripheral surface 14*b* of the muffling member 14 is protected in contact with the outer wall portion 12*b* of the cover member 12. In contrast, in the exhaust muffler 30 of the second embodiment, a cushioning material 31 such as glass wool is filled between the outer peripheral surface 14*b* of the muffling member 14 and the outer wall portion 12*b* of the cover member 12. The end surface 14*d* of the muffling member 14 abuts on the bottom wall portion 12*a* of the cover member 12, and the muffling member 14 is held by the cover member 12 in the axial direction of the inner cylinder 13. The cover member 12 and the cushioning material 31 further improve the protection performance of the muffling member 14.

Although the embodiments of the present invention have been described above, the present invention is not limited to the embodiments described above, and various design changes can be made without departing from the gist of the present invention. It is needless to say that a saddle-riding type vehicle, an internal combustion engine, and the like are implemented in various forms within the scope of the gist of the present invention.

Note that, although left-right arrangements of the illustrated embodiments have been described for the sake of convenience of description, the present invention includes different left-right arrangements as long as the arrangements are within the scope of the gist of the invention.

REFERENCE SIGN LIST

1 Motorcycle
4 Engine

10 Exhaust muffler
11 Outer cylinder
12 Cover member
12*a* Bottom wall portion
12*b* Outer wall portion
13 Inner cylinder
13*a* Porous wall portion
13*b* Communication hole
13*d* Outer wall portion
14 Muffling member
14*b* Outer peripheral surface
14*c* Exhaust gas inflow surface
20 Holding member
30 Exhaust muffler
31 Cushioning material
S Introduction chamber

The invention claimed is:

1. An exhaust muffler for an engine, comprising:

an outer cylinder that forms an introduction chamber into which an exhaust gas from the engine is introduced; and a muffling member through which the exhaust gas flows, the muffling member being arranged in the introduction chamber and made of a foamed ceramic material, wherein an inner cylinder through which the exhaust gas passes is provided in the outer cylinder, the muffling member having a cylindrical shape, a part of an inner peripheral surface of the muffling member has a cylindrical recess serving as a holding member fitting recess and a holding member made of cushioning material is fitted in the holding member fitting recess, at least a part of the muffling member is supported by an outer wall of the inner cylinder via the holding member, the inner cylinder includes, in an area where the inner cylinder overlaps with the muffling member with respect to an axial direction of the inner cylinder, a porous wall portion provided with communication holes communicating an inside and an outside of the inner cylinder, the holding member is arranged at a position where the holding member does not overlap with at least a part of the porous wall portion with respect to the axial direction of the inner cylinder, and arrangement is such that the exhaust gas having passed through the muffling member flows into the inner cylinder through the communication holes.

2. The exhaust muffler according to claim 1, wherein the muffling member has an exhaust gas inflow surface through which the exhaust gas in the introduction chamber is introduced into the muffling member, and with respect to the axial direction of the inner cylinder, the exhaust gas inflow surface is provided on a side opposite to the communication holes across the holding member.

3. The exhaust muffler according to claim 2, wherein the muffling member has an outer peripheral surface provided with an outer wall that suppresses passing of the exhaust gas.

4. The exhaust muffler according to claim 3, wherein the outer wall of the inner cylinder is provided with a positioning projection on a rear side adjacent to the holding member with respect to the axial direction of the inner cylinder.

5. The exhaust muffler according to claim 2, wherein the muffling member is provided with a inner peripheral surface in contact with the inner cylinder on a side opposite to the holding member across the communication holes of the inner cylinder with respect to the axial direction of the inner cylinder.

6. The exhaust muffler according to claim 2, wherein the outer wall of the inner cylinder is provided with a positioning projection on a rear side adjacent to the holding member with respect to the axial direction of the inner cylinder.

7. The exhaust muffler according to claim 1, wherein the muffling member has an outer peripheral surface provided with an outer wall that suppresses passing of the exhaust gas.

8. The exhaust muffler according to claim 7, wherein the outer wall of the inner cylinder is provided with a positioning projection on a rear side adjacent to the holding member with respect to the axial direction of the inner cylinder.

9. The exhaust muffler according to claim 7, wherein a cushioning material is interposed between the outer wall and the outer peripheral surface of the muffling member.

10. The exhaust muffler according to claim 1, wherein the outer wall of the inner cylinder is provided with a positioning projection on a rear side adjacent to the holding member with respect to the axial direction of the inner cylinder.

* * * * *